United States Patent [19]

Grather et al.

[11] 4,138,977

[45] Feb. 13, 1979

[54] IGNITION SYSTEM FOR INTERNAL COMBUSTION ENGINE

[75] Inventors: Günter Gräther, Pinache; Friedrich Rabus, Schwieberdingen, both of Fed. Rep. of Germany

[73] Assignee: Robert Bosch GmbH, Stuttgart, Fed. Rep. of Germany

[21] Appl. No.: 798,331

[22] Filed: May 19, 1977

[30] Foreign Application Priority Data

May 28, 1976 [DE] Fed. Rep. of Germany ..... 2623865

[51] Int. Cl.[2] ..... F02P 1/00; F02P 5/04

[52] U.S. Cl. ..... 123/117 R; 123/117 D; 123/148 E; 315/209 R

[58] Field of Search ..... 123/148 E, 117 R, 117 D, 123/32 EK; 315/209 R

[56] References Cited

U.S. PATENT DOCUMENTS

| | | | |
|---|---|---|---|
| 3,605,713 | 9/1971 | Masters et al. | 123/148 E |
| 3,745,985 | 7/1973 | Hohne | 123/148 E |
| 3,791,356 | 2/1974 | Saita | 123/117 R |
| 3,889,651 | 6/1975 | Hudson | 123/148 E |
| 3,938,490 | 2/1976 | Snyder et al. | 123/148 E |
| 3,990,417 | 11/1976 | Tershak | 123/117 R |
| 4,030,469 | 6/1977 | Chateau | 123/148 E |
| 4,041,912 | 8/1977 | Sessions | 123/148 E |

*Primary Examiner*—Charles J. Myhre
*Assistant Examiner*—P. S. Lall
*Attorney, Agent, or Firm*—Flynn & Frishauf

[57] ABSTRACT

A signal generator, such as a breaker contact, an electronic ignition control system, or the like, provides signals when an ignition event is to occur, to control the operation of a controlled switch, connected in circuit with a spark coil, to open the circuit and induce a pulse for application to a spark plug. To provide a sequence of pulses to the spark plug for any one ignition event, a pulse generator is enabled when an ignition event is commanded. To ensure generation of at least one pulse, even under abnormal conditions which inhibit proper operation of the pulse generator, a timing circuit is connected to the ignition circuit, controlled by the signal generator commanding the ignition event and opening the circuit to the controlled switch to ensure generation of at least one spark pulse; the timing circuit has a longer time constant than the frequency generator under normal operation and thereby provides its command pulse to the controlled switch only upon failure of operation of the frequency generator under normal conditions.

12 Claims, 3 Drawing Figures

IGNITION SYSTEM FOR INTERNAL COMBUSTION ENGINE

Cross reference to related applications and patent, assigned to the assignee of the present application:

U.S. Pat. No. 3,892,219;

U.S. Ser. No. 776,735, filed Mar. 11, 1977;

U.S. Ser. No. 799,249, filed May 23, 1977; GRATHER et al (claiming priority German Application P 26 23 864.2, attorney docket FF 7074, R. 3265).

U.S. Pat. No. 3,926,557.

U.S. Pat. No. 3,797,364.

U.S. Pat. No. 3,779,226.

U.S. Pat. No. 3,636,936.

U.S. Pat. No. 3,626,970.

U.S. Pat. No. 3,593,696.

U.S. Pat. No. 3,489,729.

The present invention relates to ignition systems for internal combustion engines, and more particularly to an ignition system in which a sequence of pulses is applied to a spark plug to generate therein a train of spark discharges, referred to as an extended spark, which system is so arranged that spark discharges will be provided reliably under all operating conditions.

Sequential discharges to form a train of sparks can be generated, for example, by flip-flop circuits, frequency generators, or the like, which may themselves include switching or flip-flop circuits. The frequency generators, in one form, are constructed as flip-flops with timing circuits to control the gaps between two changeovers of the flip-flop (FF). The timing of the FF can then be so arranged that the gaps between two signals, which control closing of an electrical switch in the primary of an ignition coil, are less than the time required to completely discharge the magnetic energy stored in the coil. Under such conditions it may occur that, if the supply voltage is low, the threshold voltage of the FF is not reached and thus the switch in the primary is never controlled to open, so that ignition failure will be the result. It is an object of the present invention to provide a system in which such failure will not occur.

Subject matter of the present invention: Briefly, the switch connected in series with the ignition coil — typically a transistor — is additionally controlled by a further timing and control circuit which, in turn, is controlled by the signal generator commanding the ignition events. This additional timing circuit is ordinarily ineffective; if the supply voltage should be too low, however, or if there is failure of the frequency generator, or the components thereof — for example the FF circuit therein — the additional timing circuit provides a single pulse to the controlled switch so that at least one ignition pulse will be applied to the spark gap and an ignition event is still commanded.

Systems providing pulse trains to command extended sparks, i.e., trains of ignition events have previously been proposed — see the above referred-to U.S. Pat. No. 3,892,219. This system shows generation of a train of pulses by FF circuits. It is not immune, however, to voltage swings, particularly low-voltage conditions, and it has been found that, upon excessively low voltage, the threshold valve of the FF circuit thereof is not reached, resulting in failure of ignition. This is avoided by the system in accordance with the present invention.

The system in accordance with the pesent invention has the advantage that the additional timing circuit provides for an ignition spark even upon low supply voltage, so that at least one spark, commanding an ignition event, will be generated. The FF circuit itself is preferably so constructed that it includes a capacitor which is charged through a resistor, supplied by the supply voltage source so that the train of pulses provided by the FF of the frequency generator will have a relationship to the supply voltage.

Drawings, illustrating an example:

Figure 1:
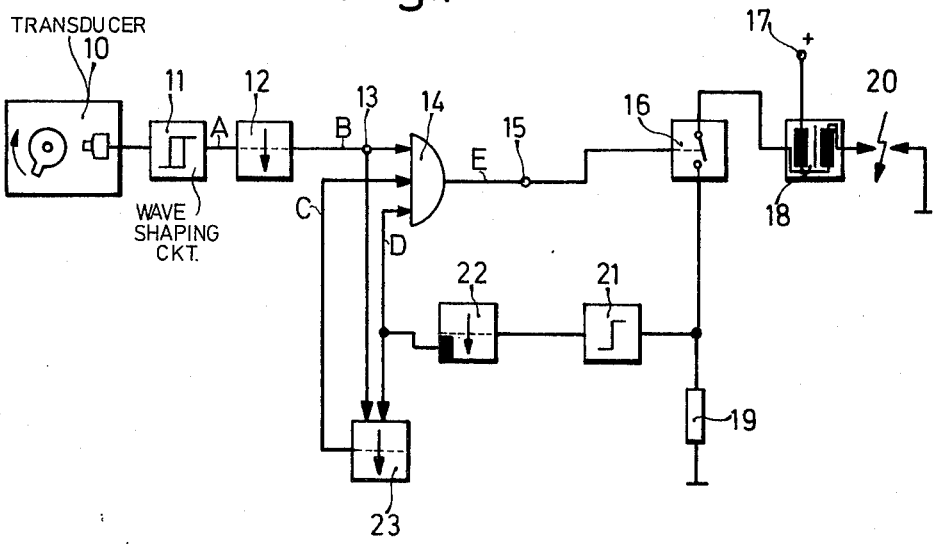
FIG. 1 is a schematic block diagram of an embodiment of the invention, illustrating a spark train system.

A transducer 10 provides ignition event control signals. Transducer 10 is coupled to the crankshaft of an internal combustion engine (not shown) and delivers its output pulses to a wave-shaping circuit 11, preferably in form of a Schmitt trigger. Transducer 10 is shown in FIG. 1 as an inductive transducer; other types of signal generators may be used, for example breaker contacts, Hall generators, optical signal generators, or the like. The output of wave-shaping stage 11 is connected through a monostable flip-flop (FF) 12 to a terminal 13. Terminal 13 is connected to one input of an AND-gate 14. The timing of the ignition event with respect to engine crankshaft position could be changed by including in the circuit an additional ignition timing control stage (not shown). Such a timing control stage — as known in the art — can change the timing of the ignition event with respect to engine crankshaft position as a function of operating parameters such as, for example, engine speed, induction pipe pressure or, rather, vacuum, temperature, position of the engine throttle, exhaust gas composition, or the like.

The output of the AND-gate 14 is connected to a terminal 15 and then to the control input of a controlled switch 16 which, preferably, is a control transistor, or a similar controllable semiconductor switch. A positive supply source 17 is provided which is connected to one terminal of the primary of an ignition coil 18, the other terminal of which is connected to the main switching path of the controlled switch 16 and then through a current measuring resistor 19 to ground, chassis, or reference potential. The secondary of ignition coil 18 has one terminal connected to the primary, at the grounded side, and the other to a spark gap, here shown as spark plug 20. For multi-cylinder enginers, a distributor can be interposed between the output of the secondary of the spark coil and the respective spark plugs, as well known. If, in addition, high voltage accumulation is desired, the secondary of the ignition coil 18 will then have a high voltage diode connected in series therewith, as explained in the cross-referenced application Ser. No. 776,735.

The junction between the switch 16 and the current measuring resistor 19 is connected to a threshold stage 21, the output of which controls a second monostable FF 22, the output of which is connected to a further input of the AND-gate 14. A third monostable FF 23 is provided, having its output connected to a third input of the AND-gate 14. It is controlled from the output of the second FF 22. A further input is connected from terminal 13 to the third FF 23.

Figure 2:
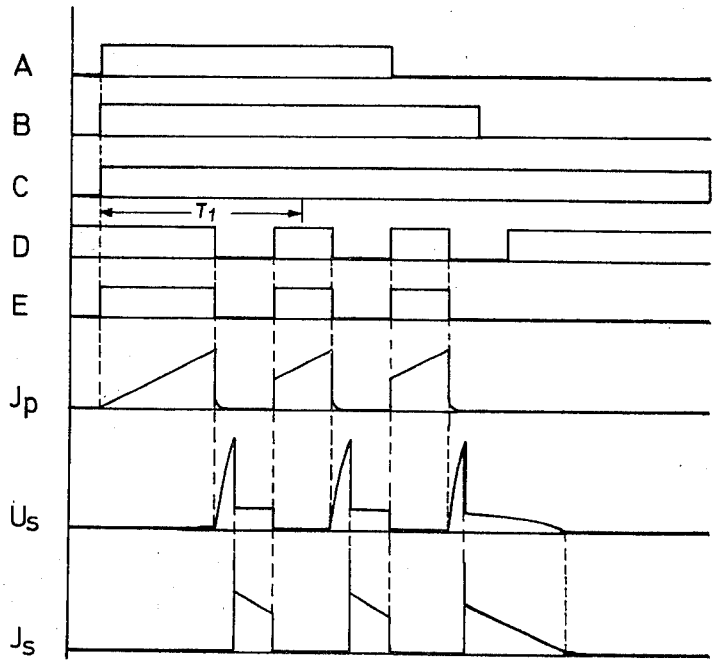
FIG. 2 is a series of timing diagrams showing signals occurring in the system of FIG. 1, labelled by letters which are similarly indicated on FIG. 1.

Operation, with reference to FIG. 2: The output signal from transducer 10, after wave-shaping in circuit 11, is illustrated in graph A of FIG. 2. The first monostable FF 12 converts the signal of graph A into a signal of predetermined length, as seen in graph B. The various monostable FF's operate as timing circuits; they have been shown as monostable flip-flops, although other timing circuits may be used. The timing period of the FF 12 can be controlled, for example, by engine operating parameters, particularly by engine speed. The signal of graph B determines the length of the duration of the spark train, that is, the duration of sequential sparks across the spark gap 20. The signal of graph A could also be used to limit the duration of spark trains at the spark gap 20.

The customary notation in digital technology will be used in connection with a further explanation of the operation; a 1-signal is defined herein as a voltage which is in the order of the level of the supply voltage, and a 0-signal a voltage which corresponds approximately to reference voltage.

The monostable FF 23 has, in quiescent state, a 0-signal at its output. It is triggered by the signal shown in graph B, causing the stage 23 to change to a 1-signal for the timing duration of the stage 23. The output signal from stage 23 is shown in graph C, and applied to a second input of the AND-gate 14. The output of the timing stage 22, in quiescent condition, has a 1-signal, as indicated by the output being taken from the inverse output terminal. Thus, upon commencement of the signal of graph B, all of the inputs of the AND-gate 14 will have a 1-signal applied, generating an output signal illustrated in graph E. This signal causes switch 16 to close. Upon closing of switch 16, primary current Jp begins to flow through ignition coil 18. This primary current also flows through the current measuring resistor 19. The voltage drop across resistor 19 is applied to the input of the threshold switch 21. When the current through resistor 19 has reached a value which causes a voltage exceeding the threshold level of the threshold stage 21, stage 21 changes over, thus changing over the timing stage 22 to commence a timing interval and providing at that instant an output at its output circuit which changes from the 1-signal to a 0-signal. The duration of this 0-signal will depend on the timing duration as determined by the circuit of stage 22. The output of the AND-gate 14 is thus also controlled to become zero, causing switch 16 to open. As a result, the current Jp drops abruptly, inducing a secondary voltage Us in ignition coil 18, resulting in flash-over of the spark gap 20. After a predetermined period of time, which corresponds to the timing duration of the timing stage 22, stage 22 will revert to its quiescent state, and thereby change its output to a 1-signal. This re-energizes the AND-gate 14, causing switch 16 to close. The cycle will repeat again anew. It will continue until the signal B terminates, at which time the gate 14 opens.

After breakdown of the spark gap 20, that is, after induction of a secondary voltage in coil 18, a re-charging current Js will commence to flow in the coil, tending to maintain the current. This current flow will continue until the magnetic energy in the spark gap is completely dissipated. The timing of the stage 22 is so arranged that the switch 16 can be re-closed before the discharge current Js has completely dropped to zero. Thus, a certain remanent or remainder magnetic energy will be stored in ignition coil 18. Upon subsequent closing of switch 16, therefore, the primary current Jp will not start from zero value, but rather from a value corresponding to the remaining energy still stored in the coil. Thus, the primary current first jumps immediately to the level corresponding to this energy and the time required for the current to then rise to the level at which threshold switch 21 will respond and again change over the state of the timing stage 22 will be less than when the current starts from zero level. The necessary current value to provide a sufficiently intense voltage at the secondary to cause a breakdown of spark gap 20 will therefore be less for subsequent cycles. Accordingly, the closing time of the switch 16 can be less in subsequent cycles, thus permitting a higher frequency or repetition rate of the discharges across spark gap 20 within the discharge train.

The stage 23, provided in accordance with the present invention, is a safety stage which ensures that a spark will be generated even though the supply voltage at terminal 17 may be low. This spark is being generated, in any event, a resonable time after the first breakdown of the spark gap 20 would have occurred — given a normal supply voltage — and not only at a time when the signal shown in graph B would terminate, which is much later, and may be too late to provide for effective ignition to the engine.

Let it be assumed that the supply voltage at terminal 17 is low. The primary current through ignition coil 18 may then never reach the threshold value which causes threshold switch 21 to respond. No ignition spark would then occur, since the switch 16 would not open until termination of the signal shown in graph B. Stage 23 is provided, entirely independently of current flow through the coil and, after its timing period, changes over to a 0-signal, thus disabling after its timing interval the AND-gate 14 and causing opening of the switch 16, and hence generation of a spark. Under normal supply voltage conditions, that is, when the primary current through coil 18 is sufficient, the stage 23 is not operative, since its holding time T1 is longer than the holding time of the timing circuit 22, and is additionally selected to be longer than the current rise time through the primary of the coil 18. Stage 23, under ordinary conditions, is re-enabled each time before termination of its holding time by the output from stage 22, connected to a second input terminal. The input terminals from junction 13 and from the output of stage 22 can be connected together through an OR-gate or other suitable buffer circuits, preventing mutual interference of the outputs from stages 12 and 22.

Figure 3:
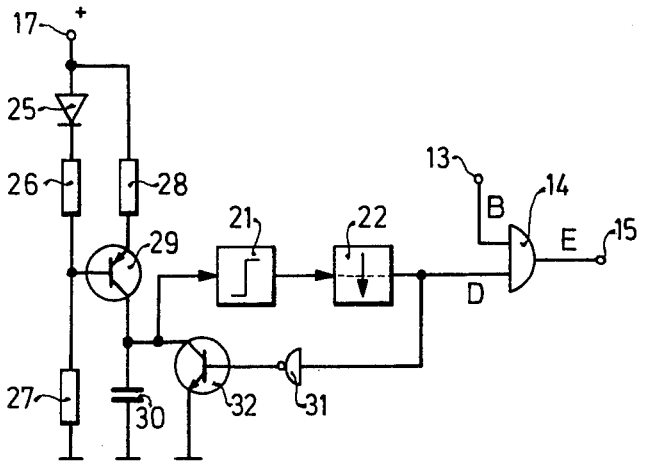
FIG. 3 is a fragmentary circuit diagram showing a frequency generator circuit for use in a spark train ignition system, in which the repetition frequency of recurring sparks depends on supply voltage.

Referring now to FIG. 3, which illustrates a particularly suitable and simple trigger circuit: Terminal 17 is connected through the series connection of a compensating diode 25 and two resistors 26, 27 to ground, chassis or reference potential; it is, additionally, connected to a collector resistor 28, the emitter-collector path of a pnp transistor 29, and a charge capacitor 30, and then to chassis or reference potential. The junction between the resistors 26, 27 is connected to the base of transistor 29. The collector of transistor 29 is connected through the series circuit of the threshold stage 21 to the monostable stage 22 and hence to an input of the AND-gate 14. A second input of the AND-gate 14 is connected to the terminal 13 (FIG. 1). The output of the AND-gate 14 is connected to terminal 15, shown in FIG. 1. Elements 10, 11 and 12 can be connected, as shown in FIG. 1, to terminal 13; elements 16, 18, 20 can be connected to terminal 15 as shown in FIG. 1. The output of the monostable stage 22 is connected through an inverter 31 to the base of an npn transistor 32, the collector of which is connected to the collector of transistor 29, and the base to chassis or reference potential.

Operation of the circuit of FIG. 3: The circuit of FIG. 3, essentially, forms a particularly simple circuit to trigger the stage 21. As in the embodiment of FIG. 1, the open time of the switch 16 is determined by the holding time of the stage 22. The duration of this holding time is set as discussed in connection with FIGS. 1 and 2. Instead of sensing current flow through resistor 19, however, the closing instant of the switch 16 is determined by the voltage across capacitor 30. Thus, rather than sensing current flow through the coil 18 — and dissipating some of the current in the resistor 19 — a capacitor is being charged at a rate determined by the voltage of the supply source. This voltage rise is determined by the level of the supply at terminal 17. The resistors 26, 27 apply a voltage to the base of transistor 29 which causes transistor 29 to become conductive. Capacitor 30 is charged over resistor 28. Diode 25 is provided to compensate for the base-emitter diode of transistor 29. The voltage rise in capacitor 30 will raise the level of the voltage across capacitor 30 to a point causing response of threshold stage 21 which, at the time, starts the timing interval of the stage 22, changing over the output signal of stage 22 from a 1-signal to a 0-signal. This 0-signal is inverted by inverter 31 and applied to the transistor 32 to render the previously blocked transistor 32 conductive, permitting capacitor 30 to discharge. Additionally, the signal is applied to the AND-gate 14 which blocks, and will control the switch 13 to open for the duration of the timing established by the timing stage 22. Upon opening of switch 16, a spark voltage will be induced in the secondary of coil 18, causing breakdown of the spark gap 20, as above described. During the timing of stage 22, current flows through resistor 28 and transistor 29 and through transistor 32 to chassis or reference potential. After the timing interval of stage 22, transistor 32 will block and the charge of capacitor 32 commences anew.

In a simple case, the diode 25, the resistors 26, 27, and transistor 29 could be omitted, so that the capacitor 30 is directly charged through resistor 28. Introducing the additional components 25, 26, 27, 29 improves the linearity of the system, that is, it renders the relationship of supply voltage to charge time of the capacitor 30 more linear, since the base of transistor 29 is controlled by the voltage dependency of the supply through the voltage divider formed by resistors 26, 27.

The control circuit for the stages 21, 22 can, therefore, be current dependent, as shown in FIG. 1, or voltage dependent, as shown in FIG. 3. A safety circuit, including stage 23, can be additionally connected to the circuit of FIG. 3; it has been omitted to provide for better clarity of the illustration; of introduced, the AND gate 14 would have a third input applied thereto, terminal 13 an additional connection to a further stage 23, and the output of stage 22 likewise connected to stage 23, directly, or through an additional OR-gate having its other input connected to terminal 13. The circuit of FIG. 3 then would act as a sensing circuit with respect to the voltage condition of source 17, as well as providing a sequence of pulses under normal, ordinary voltage conditions while the additional stage 23 provides safety in case of low-voltage conditions, resulting in excessive charge time of capacitor 30 or, in an extreme case, insufficient voltage level across capacitor 30 to cause threshold stage 21 to respond.

Various changes and modifications may be made, and features described in connection with any one of the embodiments may be used with any of the others, within the scope of the invention concept.

We claim:

1. Extended spark ignition system for an internal combustion engine having an ignition coil (18) and a spark gap (20) connected to the secondary thereof;

a controlled switch (16) connected to the primary of the ignition coil (18) and controlling current flow therethrough;

ignition event signal generator means (10, 11, 12) connected to the engine and generating a pulse for each ignition event;

a pulse generator means (22) connected to and controlled by said ignition event signal generator means and providing a sequence of output pulses to said controlled switch (16) to command said switch to open and close a plurality of times to generate multiple sparks for each ignition event, and a timing means (23) controlled by said ignition event signal generator means (10, 11, 12) and by the signal (D) from said pulse generator means (22) and additionally controlling the controlled switch by providing at least one command pulse to said controlled switch to open, and cause an ignition event, at a time controlled by the timing means, upon failure of operation of said pulse generator means.

2. System according to claim 1, wherein the time constant (T1) of the timing means (23) is long with respect to the pulse width of the pulse generator means (19, 30; 21, 22).

3. System according to claim 1, further including ignition pulse current sensing means (19) connected to the ignition coil (18), sensing current flow therethrough and providing a sensed current signal when the current flow through the coil has reached a predetermined value, said sensed current signal being connected to the pulse generator means and forming a trigger signal for said pulse generator means to control the controlled switch each time the current through the coil has reached said predetermined value.

4. System according to claim 3, wherein the pulse generator means includes a pulse generator circuit (22) and a threshold circuit (21), the threshold circuit responding to the sensed current signal when the current has reached said predetermined value and controlling the pulse generator circuit to provide a pulse.

5. System according to claim 1, for use with a current source of variable voltage, wherein the pulse generator means comprises voltage sensing means (28, 30; 21) sensing voltage of said supply source and providing a sensed voltage signal representative of the voltage condition of said source, said sensed voltage signal controlling generation of pulses, said pulses being connected to the controlled switch (16) at a rate depending on the voltage of the source (17) of supply.

6. System according to claim 5, wherein the source voltage sensing means comprises a capacitor (30) and a charging and discharge circuit therefor, the capacitor being connected to said source.

7. System according to claim 6, wherein the pulse generator means includes a threshold switch (21) responding when the voltage across the capacitor (30), as it is being charged by said source, has reached the threshold level of the threshold circuit;

and a pulse generator circuit (22) connected to and controlled by the threshold circuit and providing a pulse each time the threshold circuit senses that the voltage across the capacitor has reached or exceeded said level, the pulses controlling operation of the controlled switch (16).

8. System according to claim 7, further comprising a controlled semiconductor (29) forming a portion of the charge circuit for the capacitor (30) and being connected between the source of supply (17) and said capacitor (30), to charge the capacitor;

and voltage sensitive means (25, 26, 27) connected to said voltage source (17) and controlling conduction of said controlled semiconductor (29).

9. System according to claim 1, further comprising a logic circuit (14) controlling operation of the controlled switch (16) and having the output from said pulse generator means (22) and of the timing means (23) applied thereto, and logically combining said output to provide either pulses from said pulse generator means, or from said timing means.

10. System according to claim 9, wherein the ignition event signal generator means are additionally connected to said logic circuit (14) to provide an enabling pulse thereto.

11. System according to claim 2, wherein the time constant (T1) of the timing means (23) is long with respect to the pulse width of the pulse generator means (19, 30; 21, 22).

12. System according to claim 11, wherein the pulse generator means includes electrical parameter sensing means (19, 30) sensing an operating parameter of the system and providing a sensed signal when the operating parameter has reached a predetermined level, and a pulse generator circuit responsive to said sensed signal to provide one or more pulses to the controlled switch when said predetermined level has been reached or exceeded.

* * * * *